US005875876A

United States Patent [19]

Wang

[11] Patent Number: 5,875,876

[45] **Date of Patent: *Mar. 2, 1999**

[54] WHEELED LUGGAGE WITH HANDLE ASSEMBLY

[76] Inventor: Yuan Liang Wang, P.O. Box 82-144, Taipei, Taiwan

[ * ] Notice: The term of this patent shall not extend beyond the expiration date of Pat. No. 5,393,079.

[21] Appl. No.: 711,661

[22] Filed: Sep. 9, 1996

[51] Int. Cl.[6] ..... A45C 5/14; A45C 13/10; A45C 13/26

[52] U.S. Cl. ..... 190/18 A; 190/102; 190/108; 190/115; 190/902; 150/111

[58] Field of Search ..... 190/18 A, 39, 190/115, 102, 108, 110, 902, 903; 16/115; 280/37, 655, 65.1, 47.315; 150/111

[56] References Cited

U.S. PATENT DOCUMENTS

| | | | |
|---|---|---|---|
| Re. 25,826 | 8/1965 | Ward | 190/108 |
| 2,316,328 | 4/1943 | Guenther et al. | 190/108 X |
| 4,081,061 | 3/1978 | Tucker | 190/108 |
| 4,756,394 | 7/1988 | Cohen | 190/108 X |
| 4,836,343 | 6/1989 | Arney | 190/108 |
| 4,995,487 | 2/1991 | Plath | 190/108 X |
| 5,240,106 | 8/1993 | Plath | 190/108 X |
| 5,295,565 | 3/1994 | Latshaw | 190/102 X |
| 5,375,685 | 12/1994 | Plath | 190/108 X |
| 5,393,079 | 2/1995 | Wang | 280/655.1 X |
| 5,431,265 | 7/1995 | Yoo | 190/103 |
| 5,474,162 | 12/1995 | Shyr et al. | 190/18 A |
| 5,547,052 | 8/1996 | Latshaw | 190/108 |
| 5,575,361 | 11/1996 | Chou | 190/115 X |
| 5,676,223 | 10/1997 | Cunningham | 190/110 X |
| 5,678,666 | 10/1997 | Shyr et al. | 190/108 X |

*Primary Examiner*—Sue A. Weaver
*Attorney, Agent, or Firm*—A & J

[57] ABSTRACT

A wheeled luggage including a body portion having a primary case and a secondary case engageable with the primary case by means of a zipper, a L-shaped member mounted on a bottom of the body portion, an axle disposed on the L-shaped member and mounted across the two corners, two wheel protectors each fitted in one of the two recesses of the body portion, two wheels each pivotally connected with an end of the axle, two plugs fitted on a top of the body portion and each having a cylindrical portion and a plurality of clamping members enclosing the cylindrical portion and having a distance therefrom, an annular member having an inner diameter which is just equal to an outer diameter of a cylinder formed by the clamping members, two tubular members having a lower end vertically mounted on the L-shaped member and an upper end inserted between the cylindrical portion and the clamping members of the plug, and a handle having two pull rods each inserted in one of the tubular members and provided with a guide member at a lower end.

1 Claim, 12 Drawing Sheets

WHEELED LUGGAGE WITH HANDLE ASSEMBLY

CROSS-REFERENCE

This application is related to the U.S. Pat. No. 5,393,079, owned by the same inventor.

BACKGROUND OF THE INVENTION

1. Field of the Invention

This invention relates to an improved wheeled luggage with handle assembly.

2. Description of the Prior Art

The typical time pressures encountered by a traveller meeting airplane or train schedules are often complicated by large, cumbersome and/or heavy suitcases or articles of luggage. In order to avoid the direct carrying of such luggage, individual articles of luggage are characteristically rendered movable along an underlying ground surface by the provision of a number of wheels or casters attached to the bottom surface of the luggage such that the wheels may freely spin in a direction of travel and, in some cases, pivot about an axis defined substantially perpendicular to the bottom surface. Each piece of movable luggage also classically possesses a strap or other handle positioned on the top surface or along a side or front face thereof for pulling the luggage along the ground surface and for carrying the luggage from place to place.

However, such luggage still has a lot of drawbacks and is unsatisfactory in use. Therefore, it is an object of the present invention to provide an improved wheeled luggage which is sturdy in construction and convenient in use.

SUMMARY OF THE INVENTION

This invention relates to an improved wheeled luggage.

It is the primary object of the present invention to provide a wheeled luggage which is sturdy in construction.

It is another object of the present invention to provide a wheeled luggage the handle of which can be kept at a fixed position.

It is still another object of the present invention to provide a wheeled luggage which can be conveniently connected with an additional luggage.

It is still another object of the present invention to provide a wheeled luggage which is low in cost.

It is a further object of the present invention to provide a wheeled luggage which is simple in structure.

The invention accordingly consists of features of constructions and method, combination of elements, arrangement of parts and steps of the method which will be exemplified in the constructions and method hereinafter disclosed, the scope of the application of which will be indicated in the claim following.

DETAILED DESCRIPTION OF THE PREFERRED EMBODIMENT

Figure 1:
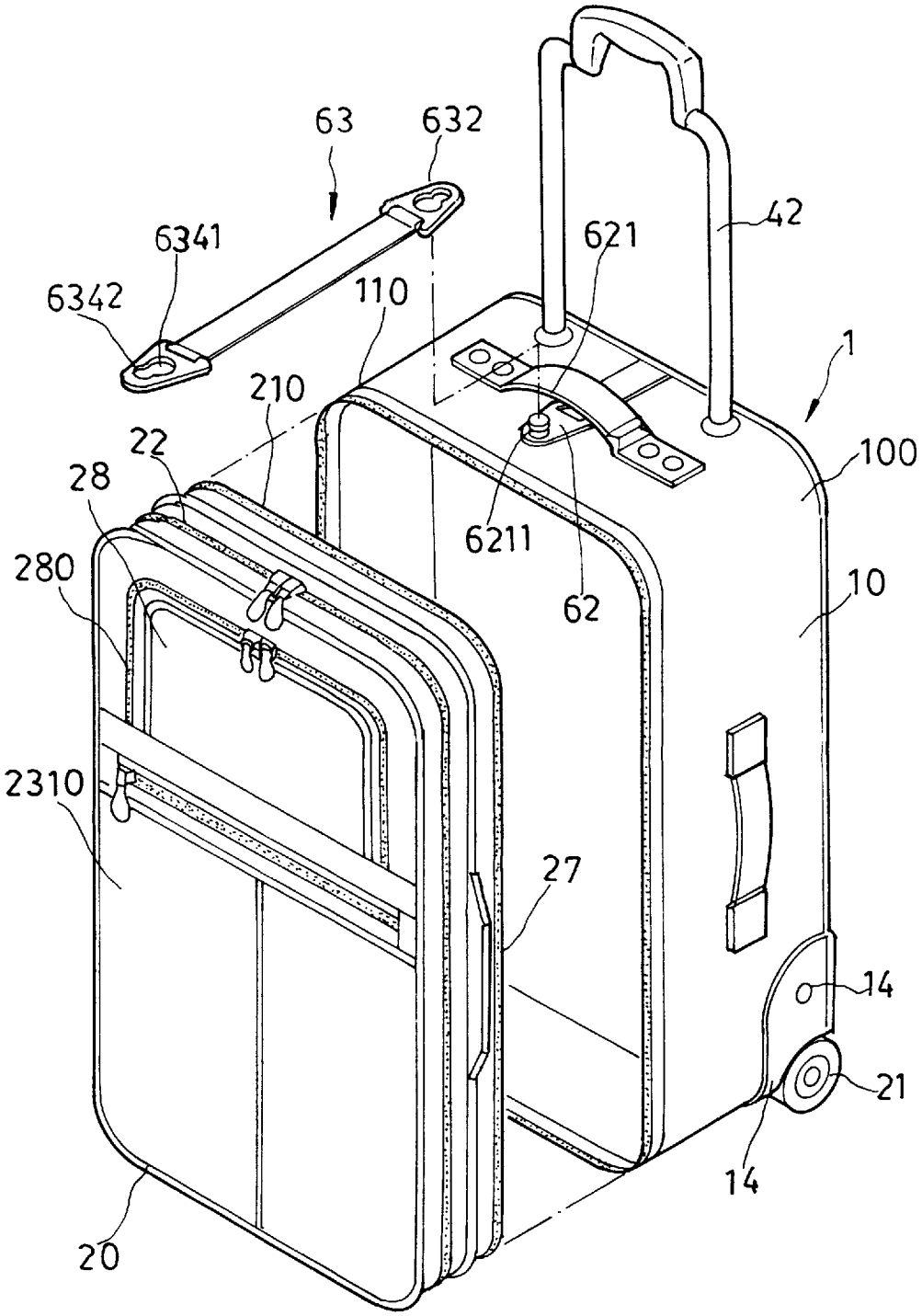
FIG. 1 is a perspective view of the present invention.

For purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 4A:
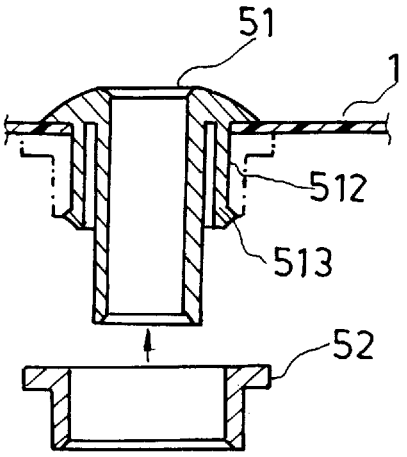
FIG. 4A shows the way to engage the sleeve with the body portion.
Figures 4B, 4C:
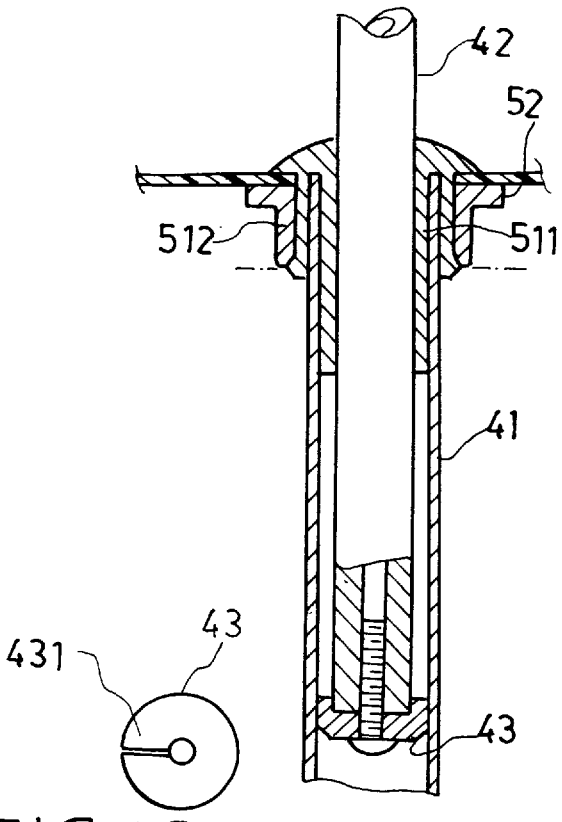
FIG. 4B is a sectional view showing the engagement between the pull rod, the tubular member and the sleeve.
FIG. 4C is a top view of the guide member.

With reference to the drawings and in particular to FIG. 1 thereof, the wheeled luggage according to the present invention comprises a body portion 1 with two wheels 21 at a lower edge of the body portion 1. On the bottom of the body portion 1 there is mounted a L-shaped member 3 which is formed with a lug 31 at both ends thereof (see FIG. 2). An axle 32 is inserted through the two lugs 31 of the L-shaped member 3. On the rear side 100 of the body portion there are two tubular members 41 (only one of them is shown in FIG. 4B) for receiving two pull rods of the handle 42. The tubular members 41 are fixedly secured on the L-shaped member 3 at the lower end, and are connected with a sleeve 5 at the upper end. A fastening strip 62 is fixedly secured on the top of the body portion 1 at one end and is provided with a knob 621 at the other end. The knob 621 is formed with an upper groove 6211 and a lower groove 6212 disposed under the upper groove 6211 and is designed to engage a strap 63. The strap 63 is provided at one end with a buckle 632 at both ends.

Figure 2:
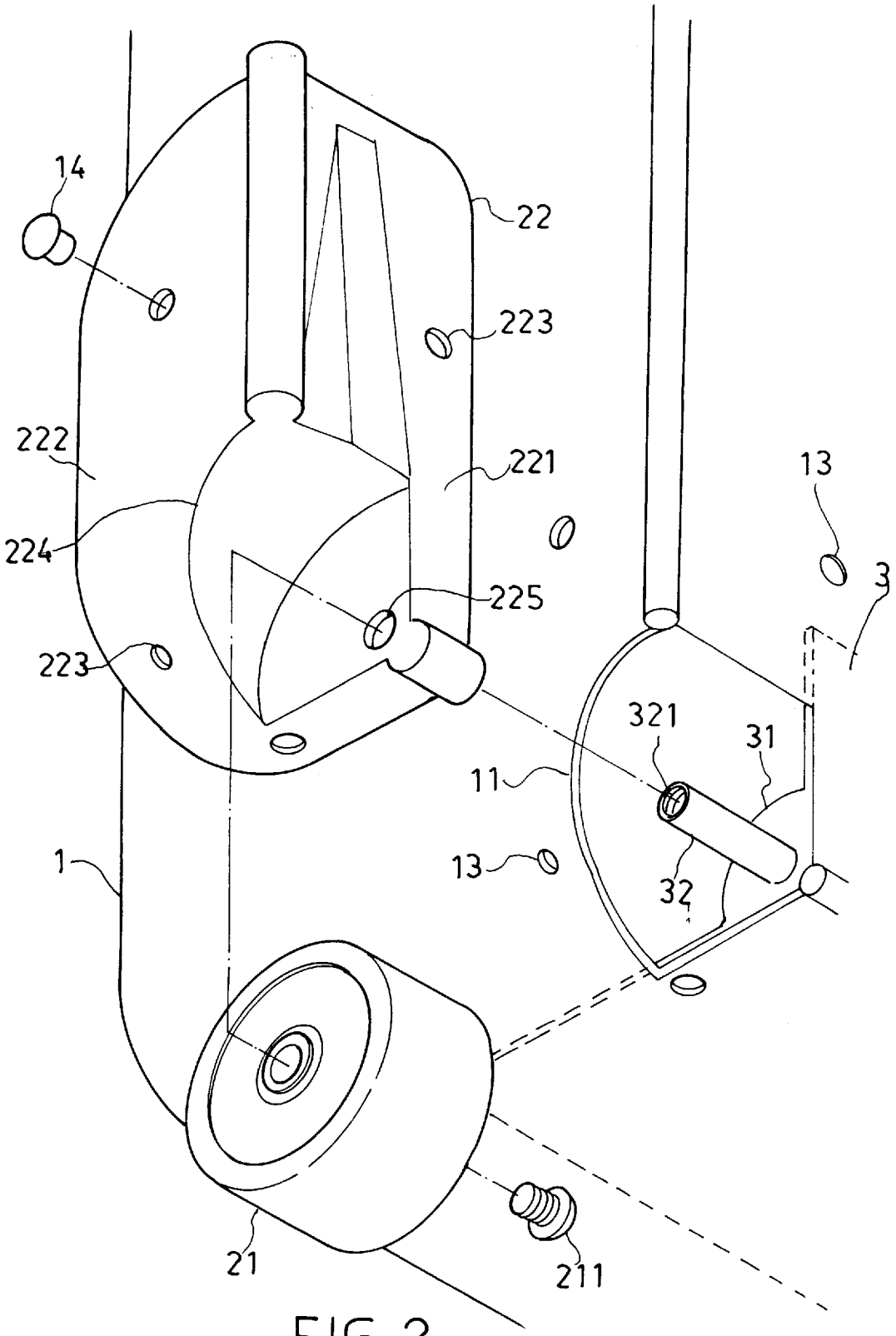
FIG. 2 is an enlarged fragmentary view of the present invention.
Figure 3:
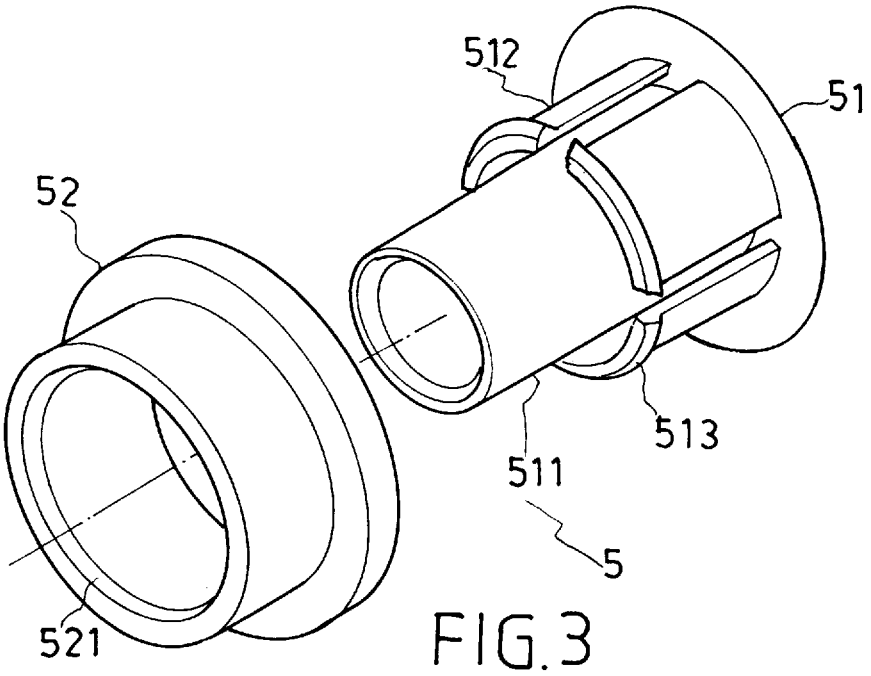
FIG. 3 is an exploded view of the sleeve.

Looking now at FIG. 2, the body portion 1 is formed with a recess 11 at both corners in alignment with the axle 32. A wheel protector 22 is mounted on the axle 32, with its hole 225 receiving the axle 32. Further, the wheel protector 22 has a contour adapted to the body portion 1 and has a first protecting side 221 and a second protecting side 222 on which there are a plurality of holes 223. The body portion 1 is also provided with corresponding holes 13 in alignment with the holes 223 so that the wheel protector 22 can be firmly mounted on the body portion 1 by rivets 14. In addition, the wheel protector 22 is formed with a recess 224 so that the wheel 21 can be disposed in the recess 224 and pivotally connected with the axle 32 by engaging a screw 211 with the threaded end 321 of the axle 32.

As illustrated in FIGS. 3, 4A, 4B and 4C, the sleeve 5 is composed of a plug 51 and an annular member 52. The plug 51 has a cylindrical portion 511 enclosed with a plurality of clamping members 512 having a hook portion 513 at the lower end. The distance between the inner side of the clamping member 512 and the outer side of the cylindrical portion 511 is slightly smaller than the wall thickness of the tubular member 41. The inner diameter of the annular member 52 is just equal to the outer diameter of the cylinder formed by the clamping members 512. Further, the annular member 52 is slightly shorter than the clamping members 512 in height. Further, the annular member 52 has an inclined surface 521 at its inner edge. The engagement between the sleeve 5 and the tubular member 41 is shown in FIG. 4B. As may be seen, the plug 51 is first mounted on the top side of the body portion 1 and then the annular member 52 is put on to the plug 51 and kept in place by the hook portions 513 of the clamping members 512. Thereafter, the tubular member 41 is inserted between the cylindrical portion 511 and the clamping members 512 of the plug 51. In the meantime, the clamping members 512 are forced to go outward thereby causing the hook portions 513 to push the annular member 52 to go upward and therefore strengthening the engagement between the sleeve 5 and the body portion 1.

The pull rod of the handle 42 is first inserted in the tubular member 41 and then a guide member 43 is threadedly engaged with the lower end of the pull rod 42. The outer diameter of the guide member 43 is slightly larger than the inner diameter of the tubular member 41. In addition, the guide member 43 is formed with a slit 431 so as to make it easier to insert the guide member 43 into the tubular member 41. Further, a partition (see FIG. 1) is arranged in front of the tubular members 41 so that the other side of the partition can be divided as required.

Figure 5A:
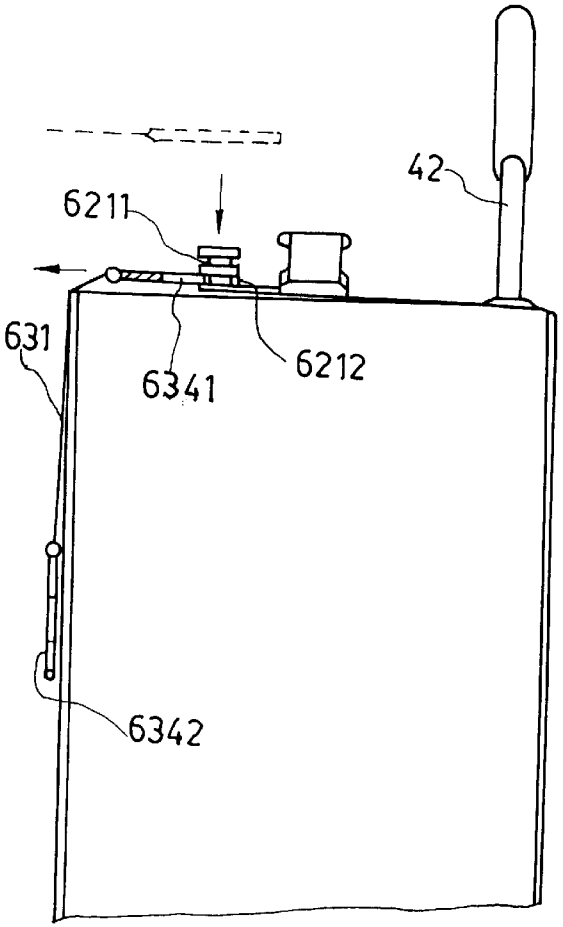
FIGS. 5A and 5B show the way to hang an additional luggage on the present invention.
Figure 5B:
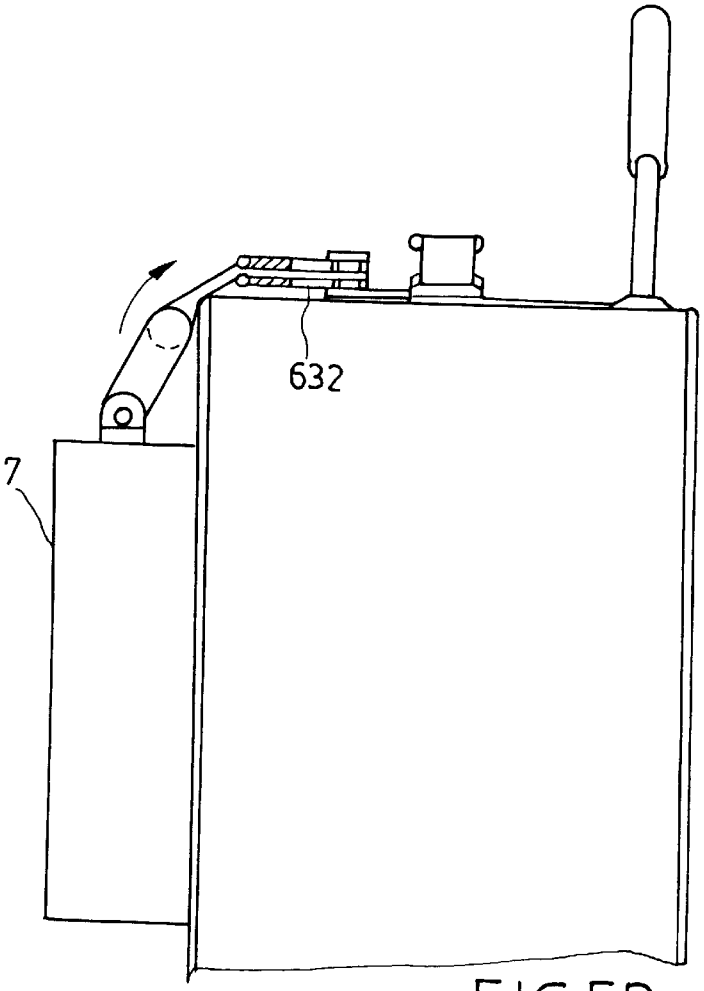

The use of the strap 63 is shown in FIGS. 1, 5A and 5B. As shown, the buckle 632 is formed with a large hole 6341 and a small hole 6342. The large hole 6341 is adapted to engage the knob 621, while the small hole 6342 adapted to engage the upper groove and lower groove 6211 and 6212. When in use, first engage the small hole 6342 of one end of the strap 63 with the lower groove 6212 of the knob 621, place the handle of a luggage 7 on the strap 63, and then engage the small hole 6342 of another end of the strap 63 with the upper groove 6211.

Figure 6:
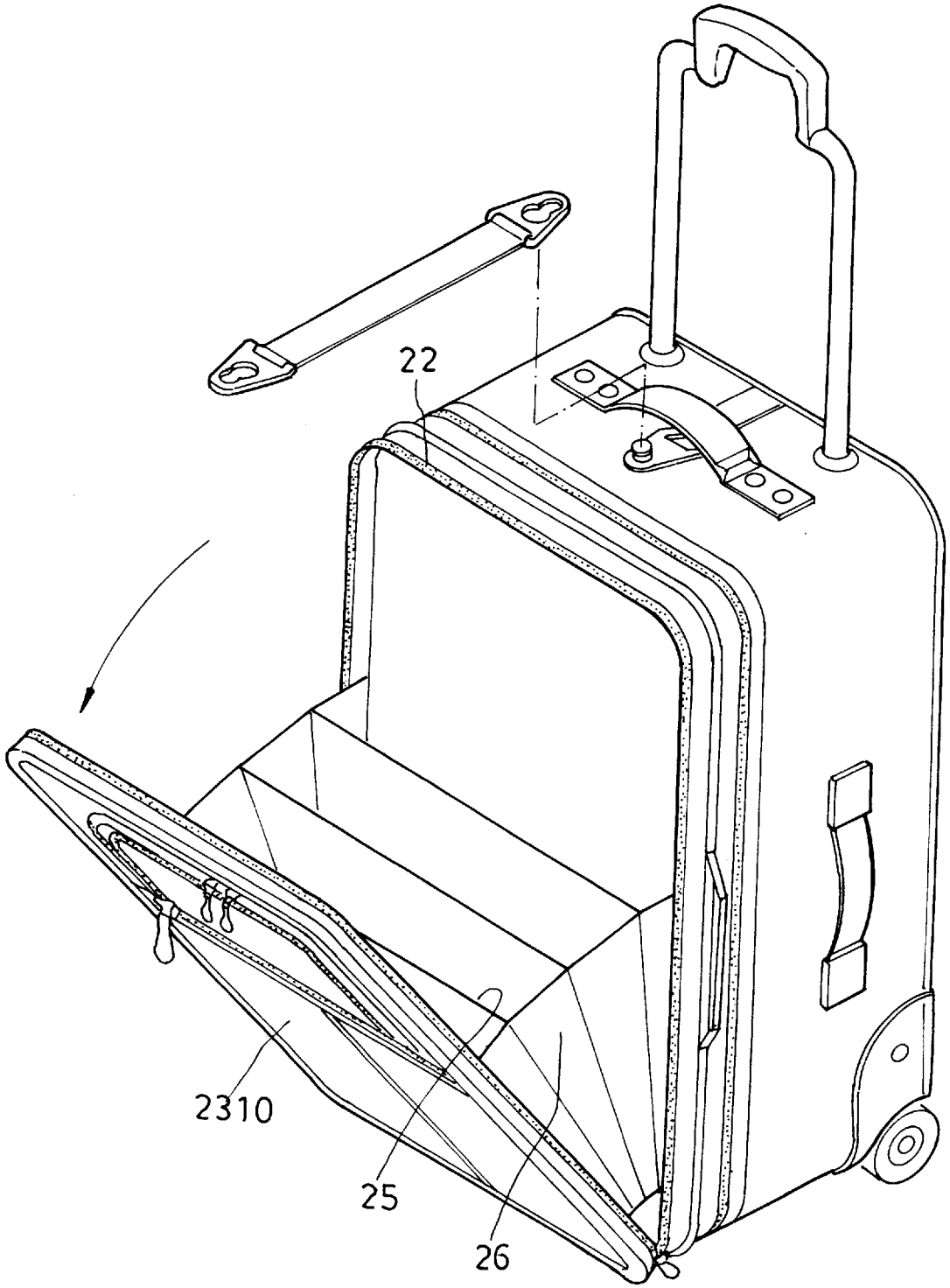
FIG. 6 illustrates the wheeled luggage with the secondary case open.
Figure 7:
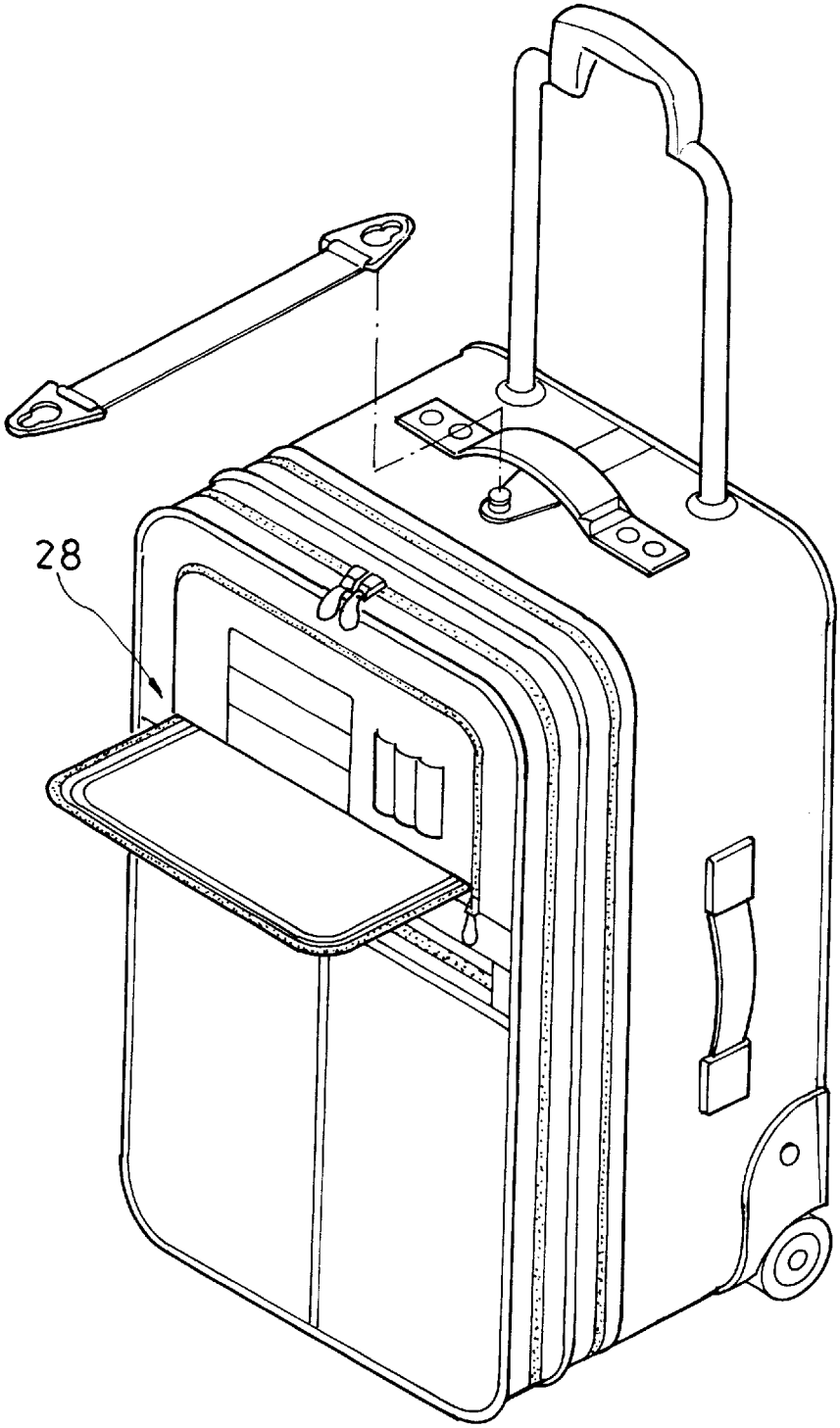
FIG. 7 illustrates the wheeled luggage with the pouch of the secondary case open.

Referring to FIG. 1, the body portion 1 includes a primary case 10 and a secondary case 20. A zipper having two rows of interlocking teeth 110 and 210 respectively mounted on the inner edges of the primary case 10 and the secondary case 20 is employed for selectively engaging and disengaging the secondary case 20 with the primary case 10. The zipper slide is not shown in the drawing. The secondary case 20 is provided with a cover 2310. Along the edges of the vertical side walls and the front edge of the top wall of the cover 2310, a zipper 22 is employed for selectively opening and closing the interior of the secondary case 20. The cover 2310 is provided with a pouch 28 and a zipper 280 is utilized to open and close the interior of the pouch 28. As shown in FIG. 6, the interior of the secondary case 20 has a plurality of partitions 25 and two side flaps 26 at two opposite sides. FIG. 7 is a perspective view of the wheeled luggage with the pouch 28 open.

Figure 8:
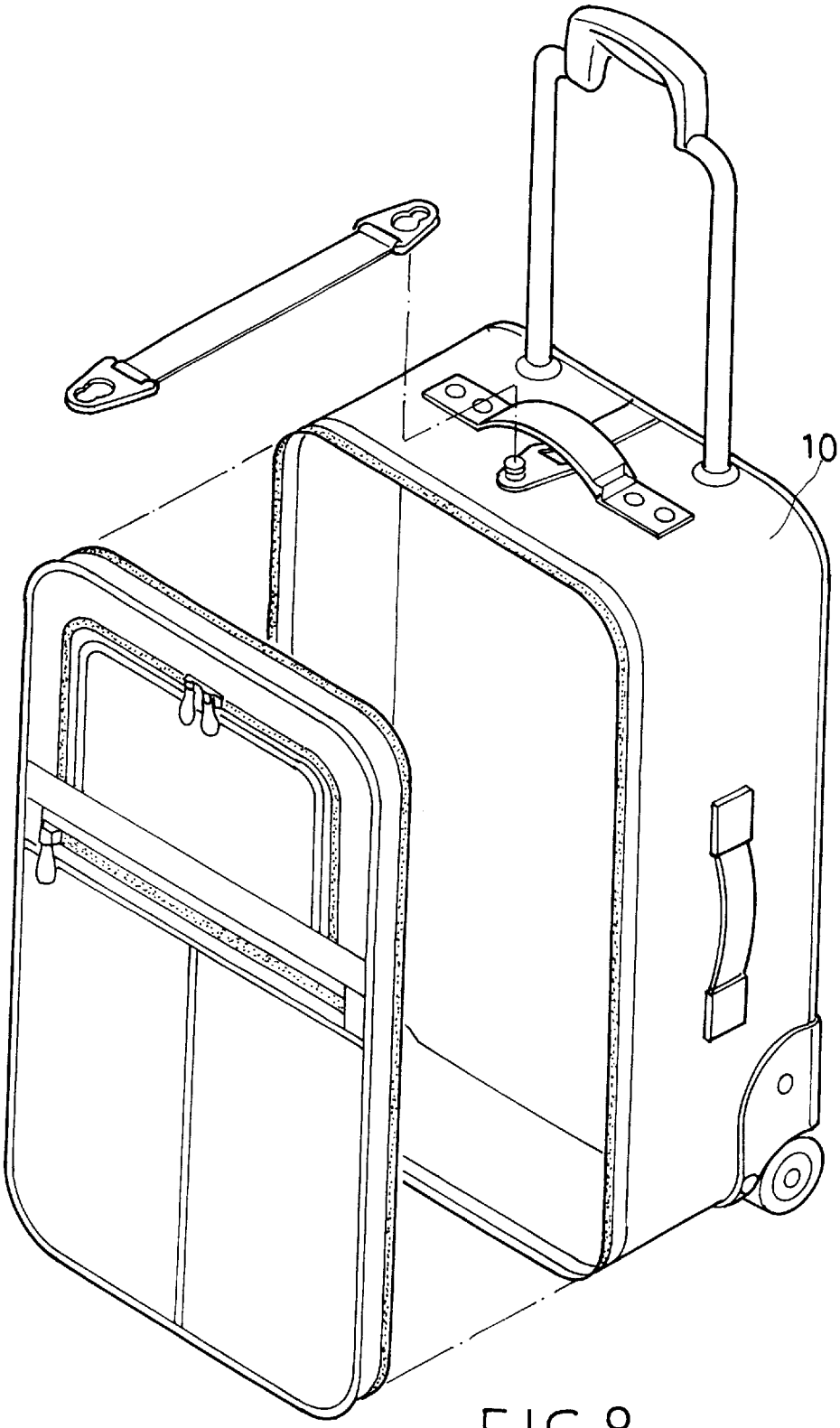
FIG. 8 illustrates a second preferred embodiment of the present invention.

FIG. 8 is a perspective view of another preferred embodiment of the present invention.

Figure 9:
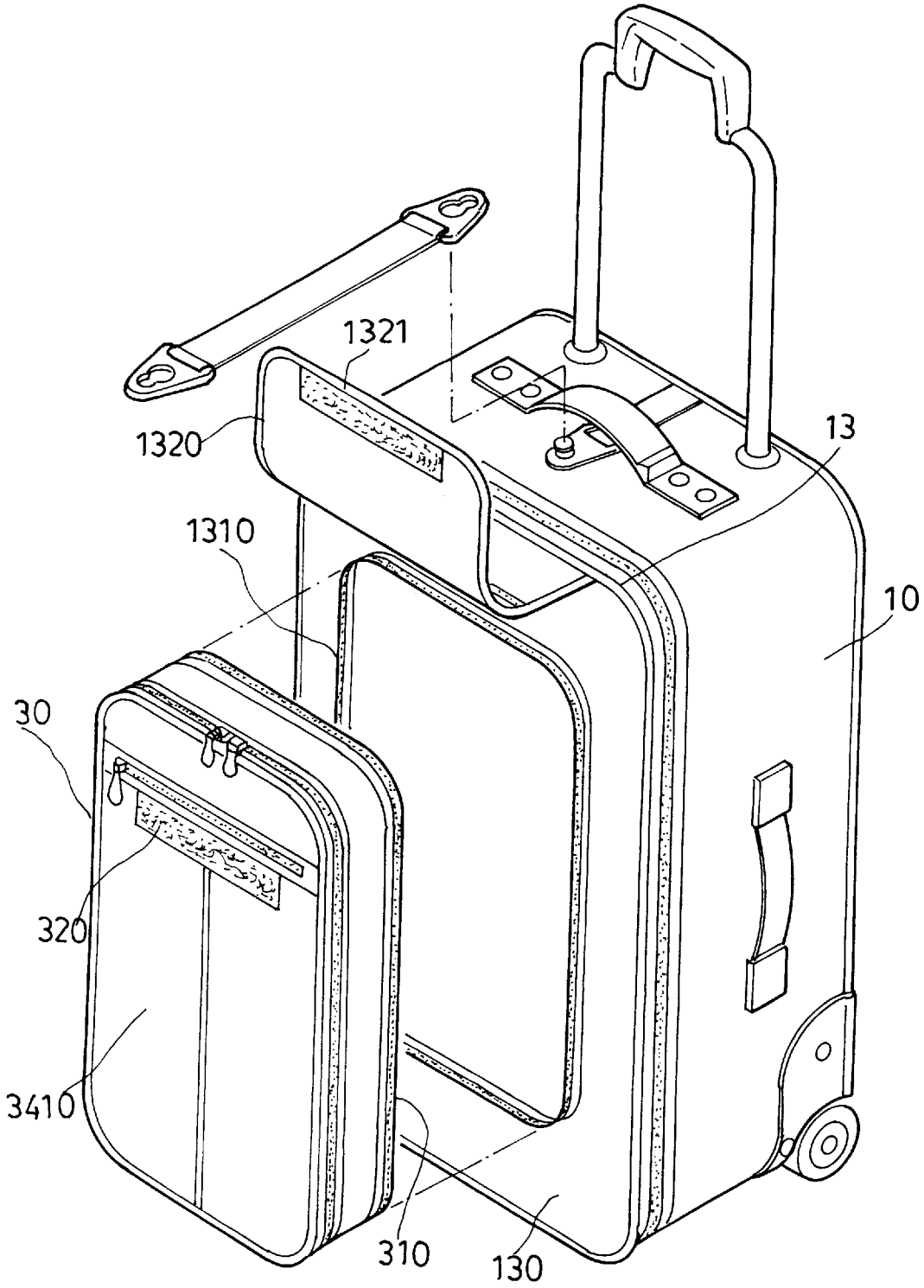
FIG. 9 illustrates a third preferred embodiment of the present invention.
Figure 10:
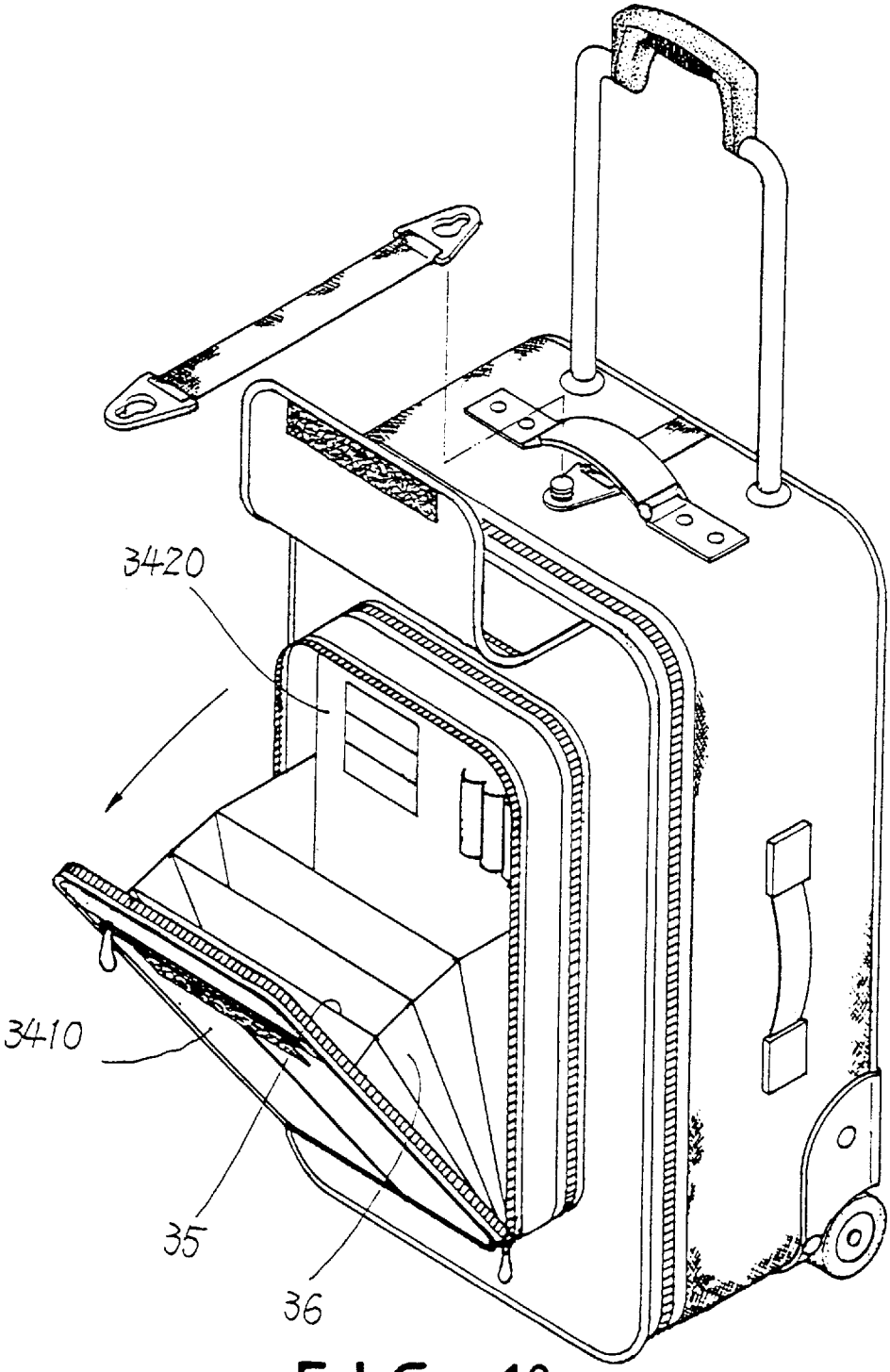
FIG. 10 illustrates the third preferred embodiment with its secondary case open.

FIGS. 9 and 10 illustrate a third preferred embodiment of the present invention. As illustrated, a row of teeth 1310 of a zipper is arranged on the front side wall 130 of the primary case 10, while another row of teeth 310 of the zipper interlockable with the teeth 1310 is mounted on the edge of the inner side of a secondary case 30, so that the secondary case 30 can be engaged and disengaged with the primary case 10. The secondary case 30 is smaller than the primary case 10 in size and provided with a self-adhesive strip 320 in the front cover 3410. The upper edge of the front side wall 13 of the primary case 10 is provided with a flap 1320 on which there is a self-adhesive strip 1321 adapted to engage with the self-adhesive strip 320 of the secondary case 30. FIG. 10 is a perspective view of the wheeled luggage with the secondary case 30 open. The interior 3420 of the secondary 30 has a plurality of partitions 35 and two side flaps 36 at two opposite sides.

Figure 11:
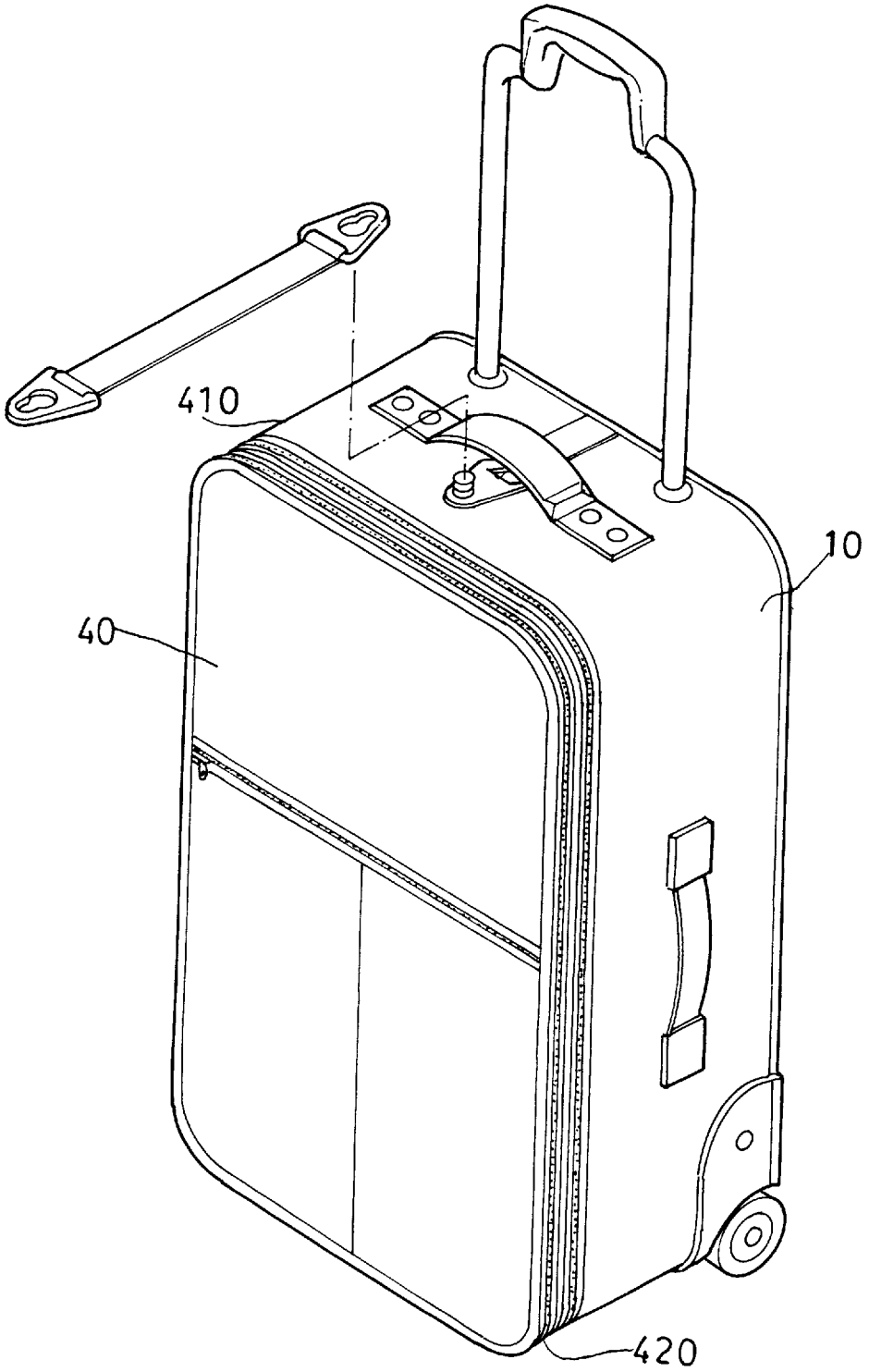
FIG. 11 illustrates a fourth preferred embodiment of the present invention.
Figure 12:
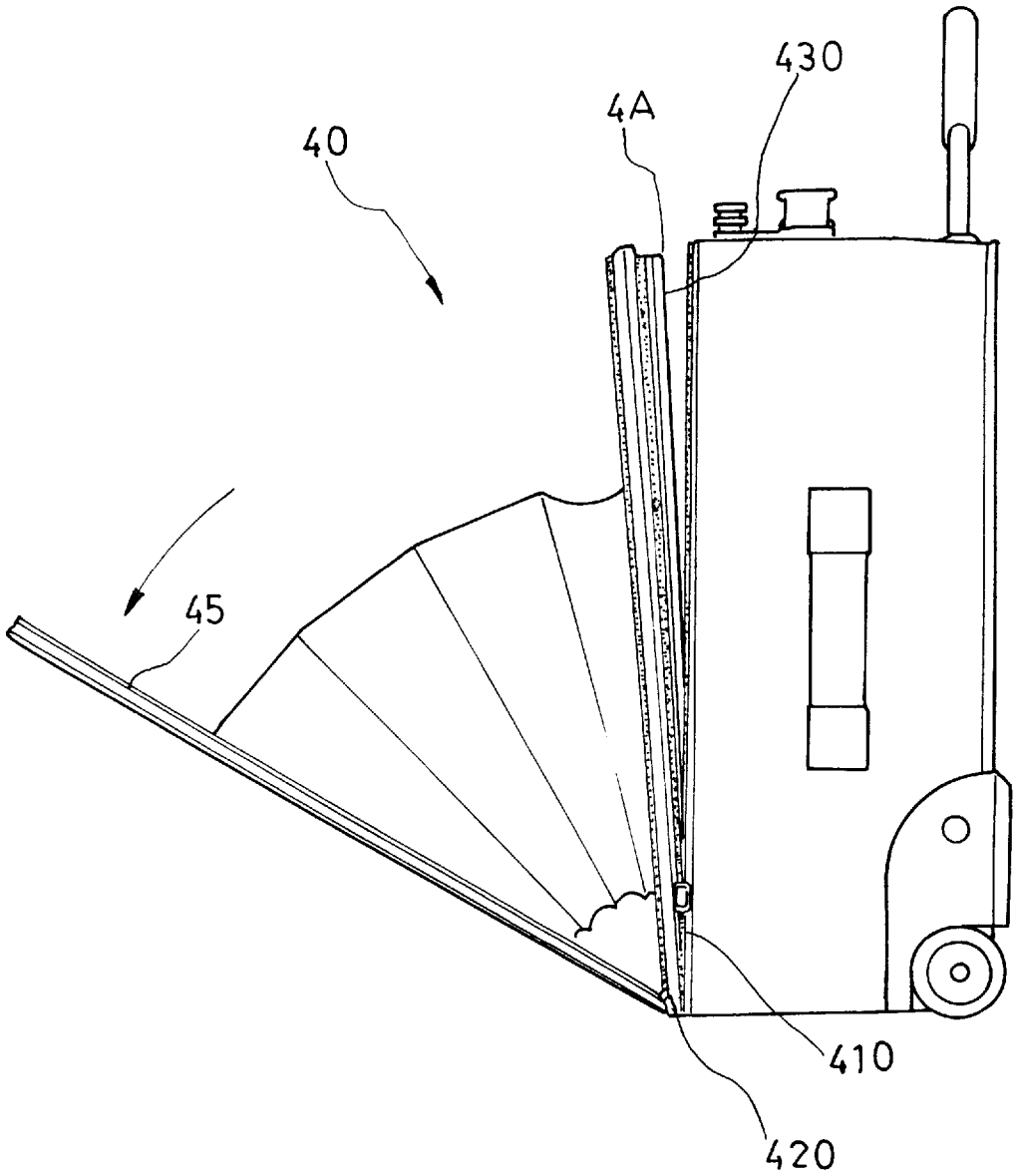
FIGS. 12 and 13 illustrate the structure of the fourth preferred embodiment.
Figure 13:
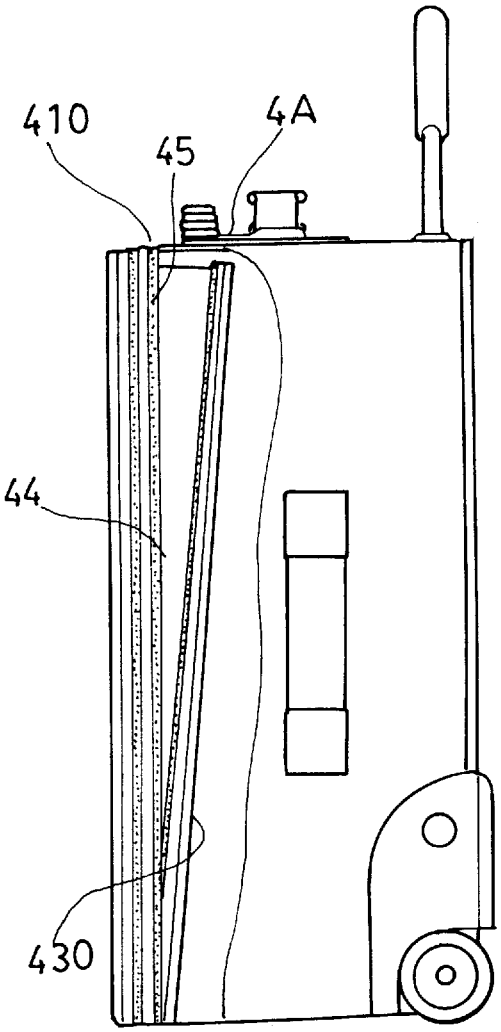

FIGS. 11, 12 and 13 illustrate a fourth preferred embodiment according to the present invention. As illustrated, the secondary case 40 is connected with the primary case 10 by a zipper 410 at the upper and two vertical side edge and by a vertical connecting means 420 at the lower edge. The rear side of the secondary case 40 is provided with a pouch 4A having a panel 430. Between the panel 430 and the primary case 10 there is mounted a flap 44. Furthermore, the secondary case 40 has a pouch at the front which is engaged with the secondary case 40 via a zipper 45.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A wheeled luggage comprising:

a body portion formed with at least two corners and having two recess each being located at one of said at least two corners, said body portion including a primary case and a secondary case engageable with said primary case by means of a first zipper, said secondary case being provided with a plurality of partitions in an interior thereof, said secondary case being provided with a cover and a second zipper between said secondary case and said cover at an upper edge and two vertical side edges thereof and said cover being pivotally connected with said secondary case, said primary case being provided at an upper side thereof with a flap having a first self-adhesive strip and said secondary case being provided at a front side with a second self-adhesive strip engageable with said first self-adhesive strip;

an L-shaped member mounted on a bottom of said body portion;

an axle disposed on said L-shaped member and mounted across said two corners;

two wheel protectors each fitted in one of said two recesses of said body portion;

two wheels each pivotally connected with an end of said axle;

two plugs fitted on a top of said body portion and each having a cylindrical portion and a plurality of clamping members enclosing the cylindrical portion and having a distance therefrom, said clamping members having a hook portion at a lower end;

an annular member having an inner diameter which is just equal to an outer diameter of a cylinder formed by said clamping members, said annular member being shorter than said clamping members in height, said annular member fitting over the clamping members of said plug;

two tubular members having a lower end vertically mounted on said L-shaped member and an upper end inserted between the cylindrical portion and the clamping members of said plug; and a handle having two pull rods each inserted in one of said tubular members and provided with a guide member at a lower end.

* * * * *